US012538992B2

(12) United States Patent
Williams

(10) Patent No.: US 12,538,992 B2
(45) Date of Patent: Feb. 3, 2026

(54) RECONFIGURABLE PILLOWCASE

(71) Applicant: Steven Williams, Boca Raton, FL (US)

(72) Inventor: Steven Williams, Boca Raton, FL (US)

( * ) Notice: Subject to any disclaimer, the term of this patent is extended or adjusted under 35 U.S.C. 154(b) by 456 days.

(21) Appl. No.: 18/070,234

(22) Filed: Nov. 28, 2022

(65) Prior Publication Data

US 2023/0088919 A1 Mar. 23, 2023

Related U.S. Application Data

(63) Continuation-in-part of application No. PCT/US2022/071666, filed on Apr. 12, 2022, and a continuation-in-part of application No. PCT/US2021/034522, filed on May 27, 2021.

(60) Provisional application No. 63/030,905, filed on May 27, 2020.

(51) Int. Cl.
*A47G 9/10* (2006.01)

(52) U.S. Cl.
CPC ..... *A47G 9/1045* (2013.01)

(58) Field of Classification Search
CPC ..... A47G 9/1045; A47G 9/02853; A45F 3/04; A45F 4/00; A45C 3/04; A45C 9/00; A61G 7/1026
See application file for complete search history.

(56) References Cited

U.S. PATENT DOCUMENTS 1,380,480 A * 6/1921 Jennings ..... A47C 7/383 5/490
1,448,693 A * 3/1923 Magill ..... A45C 3/04 383/20
2,315,126 A * 3/1943 Michalke ..... A47G 9/0207 383/4
3,879,775 A * 4/1975 Iwata ..... A47G 9/1045 5/639
4,185,673 A * 1/1980 Daniello ..... A45C 9/00 383/110
4,193,152 A * 3/1980 Seibold, Jr. ..... A47G 9/0253 5/636
4,604,765 A * 8/1986 Schultz ..... A47G 9/086 5/413 AM
4,675,925 A * 6/1987 Littleton ..... A61G 7/1023 5/607

(Continued)

FOREIGN PATENT DOCUMENTS

CN 105595706 A * 5/2016
CN 208784236 U * 4/2019
CN 215348203 U * 12/2021

*Primary Examiner* — Eric J Kurilla
(74) *Attorney, Agent, or Firm* — Allen F. Bennett; Bennett Intellectual Property

(57) ABSTRACT

A reconfigurable pillowcase 10 has two congruent panels 12 of non-absorbent fabric connected at two lateral sides 14 and a closed distal end 16. Three handles 30 extend in a proximal direction from the proximal open end 18 of each panel 12. Fastening strips 22 inside the pillowcase's proximal open end 18 seal off the interior of the pillowcase. The handles 30 form one pair of medial handles 50 and two pairs of lateral handles 52 which may be folded over each other and held with a single hand. The folding of the pillowcase to align the handles creates creases in the pillowcase that improves the control a person has over the direction and motion of the pillowcase during a pillow fight.

7 Claims, 7 Drawing Sheets

(56) References Cited

U.S. PATENT DOCUMENTS 4,723,300 A * 2/1988 Aranow ..... A45C 7/00 383/4
5,110,219 A * 5/1992 Lopes ..... A45C 9/00 5/419
5,141,336 A * 8/1992 Sander ..... B65D 33/105 383/86
5,288,150 A * 2/1994 Bearman ..... A45C 3/00 383/117
5,362,062 A * 11/1994 Schott ..... A63F 9/00 D21/362
5,566,410 A * 10/1996 Schaechter ..... A47G 9/0253 5/490
10,183,783 B2 * 1/2019 Donner ..... B65D 31/10
2002/0078506 A1 * 6/2002 Sloot ..... A45C 15/00 383/3
2004/0238583 A1 * 12/2004 Gordon ..... A45F 3/04 224/576
2005/0039260 A1 * 2/2005 Tyler ..... A47G 9/062 2/84
2007/0033734 A1 * 2/2007 Gooddine ..... A47G 9/0253 5/636
2007/0261171 A1 * 11/2007 Williams ..... A47C 7/0213 5/636
2013/0239333 A1 * 9/2013 Connolly ..... A63H 3/02 5/636
2014/0151172 A1 * 6/2014 Diaz ..... A45C 7/0063 190/1
2019/0269229 A1 * 9/2019 Rosenblum ..... A47G 9/0223
2019/0282005 A1 * 9/2019 Alletto, Jr. ..... A47G 9/04
2022/0400877 A1 * 12/2022 Salama ..... A63H 33/009

* cited by examiner

RECONFIGURABLE PILLOWCASE

CROSS-REFERENCE TO RELATED APPLICATIONS

This application is a Continuation-in-Part of PCT Patent Application Serial No. PCT/US2022/071666 filed on 12 Apr. 2022 and is a continuation in part of PCT Application Serial No. PCT/US2021/034522 filed on 27 May 2021, and claims priority to U.S. Provisional Application Ser. No. 63/030,905 filed on 27 May 2020.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

BACKGROUND OF THE INVENTION

Field of the Invention

The present invention relates to a reconfigurable pillowcase adapted for both pillow fighting and sleep. More particularly, the invention relates to a reconfigurable pillowcase having a compound handle and adapted to translate between a recumbent cushioning configuration to a more controllable pillow fighting configuration.

Description of the Related Art

Pillows are intended primarily to provide a more comfortable surface for resting, sitting or sleeping. They come in many forms and shapes. Over the years, pillows have also been used for a variety of other functions. One alternative function popular with both children and adults, is to engage in pillow fighting. In a pillow fight, two or more people grasp the open side of a pillowcase housing a pillow, and strike each other with the pillows. When striking an opponent, a pillow will typically not cause actual injuries, but can knock a person off balance and/or disorient someone. However, it is nonetheless considered great fun and even entertaining to watch.

There are several difficulties associated with pillow fighting. Pillows can be damaged and torn open during pillow fight. In addition, it is often difficult to securely and firmly grasp a pillow, particularly when using it to strike something or someone. It is also difficult to strike an opponent with precision. A pillow and/or pillowcase is capable of freely rotating, swinging and twisting about the point held by a pillow fight participant. This makes a pillow difficult to control during a pillow fight, as the pillow constantly acquires unwanted or undesired angular momentum about the point at which it is held. This makes it more difficult for a participant to maintain a secure grip on the pillow or pillowcase. It also limits the available velocity and acceleration of the pillow, because the participant's movements must both impart force on the pillow and counteract the rotating and twisting forces acting on the pillow. The forces applied to a pillow/pillowcase are also limited by the strength of the material from which it is formed.

Control of a pillow or pillowcase during a pillow fight may be improved by grasping two of the four corners of the pillow. However, this greatly reduces the range of motion available to a participant, limiting the forces and directions of motion available to the participants. This also eliminates the ability to strike an opponent using a wide sweeping swing with a single arm.

A further limitation of pillows/pillowcases in a pillow fight is that they are typically made of a soft, absorbent material such as cotton, linen, wool and the like. Use of these materials greatly improves a pillow's utility during sleep or rest, because they allow sweat to dissipate, and prevent sweat from collecting between the pillow and a user. However, this is not particularly hygienic. In the current pandemic, it is desirable to avoid contact with the bodily fluids of others. When a cotton pillow is used, it will readily retain any bodily fluids in comes in contact with, and will increase the spread of viruses and bacteria to anyone in contact with the pillow/pillowcase. These typical pillowcases thus only act to increase the spread of communicable diseases between participants.

Another disadvantage of pillowcases made of cotton or other absorbent materials is that they detract from the appeal of pillow fights as a spectator sport. When struck by a cotton, or other absorbent material, pillowcase, it emits only a dull thud. A pillow fight would be more entertaining for an audience if a blow from a pillow made a louder, more dramatic sound.

A strong handle on a pillow or pillowcase improves a participant's ability to hold the pillow with a single hand. The prior art provides handbags having padding, as well as pillows, that include handles for easing transport of the device. However, the handles of the prior art do not substantially improve a participant's ability to control and direct the forces applied to the pillow. There are also pillows configured to provide a handle region and which are designed for use in a pillow fight. For example, pillows are currently provided having the shapes of battle axes, a swords, shields and other weapons. Such pillows are aesthetically pleasing, but do not improve a pillow's performance during a pillow fight.

Adding structural strength and/or rigidity to a pillow may improve its utility in a pillow fight, by reducing undesired rotational and twisting motions. However, a rigid pillow is generally less comfortable to use for its primary purpose—comfort. A rigid or semi-rigid pillow/pillowcase is less comfortable. However, a completely unrigid pillow is more difficult to control during a pillow fight.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a pillow optimized for both sleeping and pillow fighting.

BRIEF SUMMARY OF THE INVENTION

Disclosed is a pillowcase that transitions from a sleeping configuration to a pillow fighting configuration by retracting and extending one or more handles at its open end. The pillowcase is secured in the pillow fighting configuration by fasteners inside the pillowcase proximal to the opening. To convert the pillowcase to the sleeping configuration, the open end of the pillowcase, including the region where the fasteners are located, is folded inward so that the one or more handles extends inside the pillowcase instead of outward away from the opening. Additional fastener mechanisms may be employed, preferably inside the pillowcase, to secure the pillowcase in the sleeping configuration.

It is therefore an object of the present invention to provide a pillowcase capable having retractable handles and capable of transforming between a more rigid, controllable fighting configuration and a less rigid, more comfortable recumbent configuration.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein:

FIG. 15 is a cross-sectional view of an alternative embodiment of a reconfigurable pillowcase in accordance with principles of the invention;

FIG. 16 is a cross-sectional view of an alternative embodiment of a reconfigurable pillowcase turned inside-out in accordance with principles of the invention;

FIG. 17 is a cross-sectional view of an alternative embodiment of a reconfigurable pillowcase in a second recumbent configuration in accordance with the principles of the invention.

DETAILED DESCRIPTION

Figure 1:
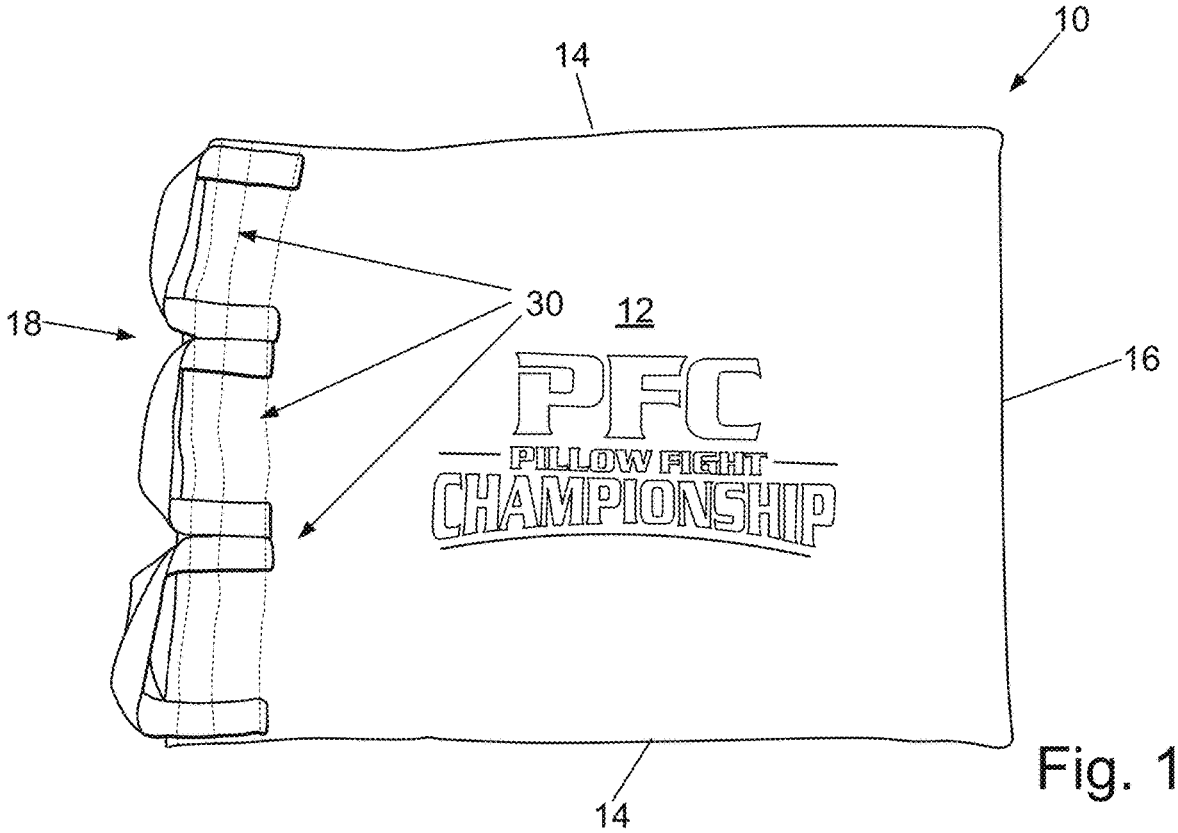
FIG. 1 is a top plan view of a reconfigurable pillowcase in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices may be shown in block diagram form in order to facilitate describing the various embodiments herein.

Various embodiments of the disclosure could also include permutations of the various elements as if each dependent claim was a multiple dependent claim incorporating the limitations of each of the preceding dependent claims as well as the independent claims. Unless explicitly stated otherwise, such permutations are expressly within the scope of this disclosure. Similarly, the disclosure should be interpreted as including permutations of the various elements disclosed in the Figures, unless the various elements are clearly mutually exclusive.

Unless otherwise indicated, all numbers expressing quantities of ingredients, dimensions reaction conditions and so forth used in the specification and claims are to be understood as being modified in all instances by the term "about". The term "a" or "an" as used herein means "at least one" unless specified otherwise. In this specification and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

For ease of understanding, the following definitions will apply throughout this description; however, no definition should be regarded as being superceding any art-accepted understanding of the listed terms.

FIG. 1 shows a reconfigurable pillowcase 10 in accordance with the principles of the invention. The reconfigurable pillowcase 10 has two opposing panels 12 connected along their two lateral sides 14 and along a closed distal end 16. In this embodiment, the two opposing panels 12 are congruent and coextensive. In this embodiment, panels 12 are formed from a single panel folded along the closed distal end 16, and stitched together along their lateral sides 14. Optionally, the two congruent opposing panels 12 may be separate components stitched together along the closed distal end 16. In this embodiment, pillowcase 10 has a standard pillowcase shape. I.e., the panels 12 are rectangular, with the longer sides of the rectangle constituting the lateral sides 14 of the pillowcase and the shorter sides constituting the closed distal end 16 and the proximal open end 18. A total of six handles 30 are arranged along the proximal open end 18, three on each panel, and extend in a proximal direction. The handles 30 are congruent and coextensive, all being of equal size and dimension. The opposing panels 12 are formed by a non-absorbent, substantially impermeable material, such as a flexible plastic. In this embodiment, the panels 12 are formed from nylon ripstop. Optionally, other nonabsorbent strong materials, for example silk, may be used.

Figure 2:
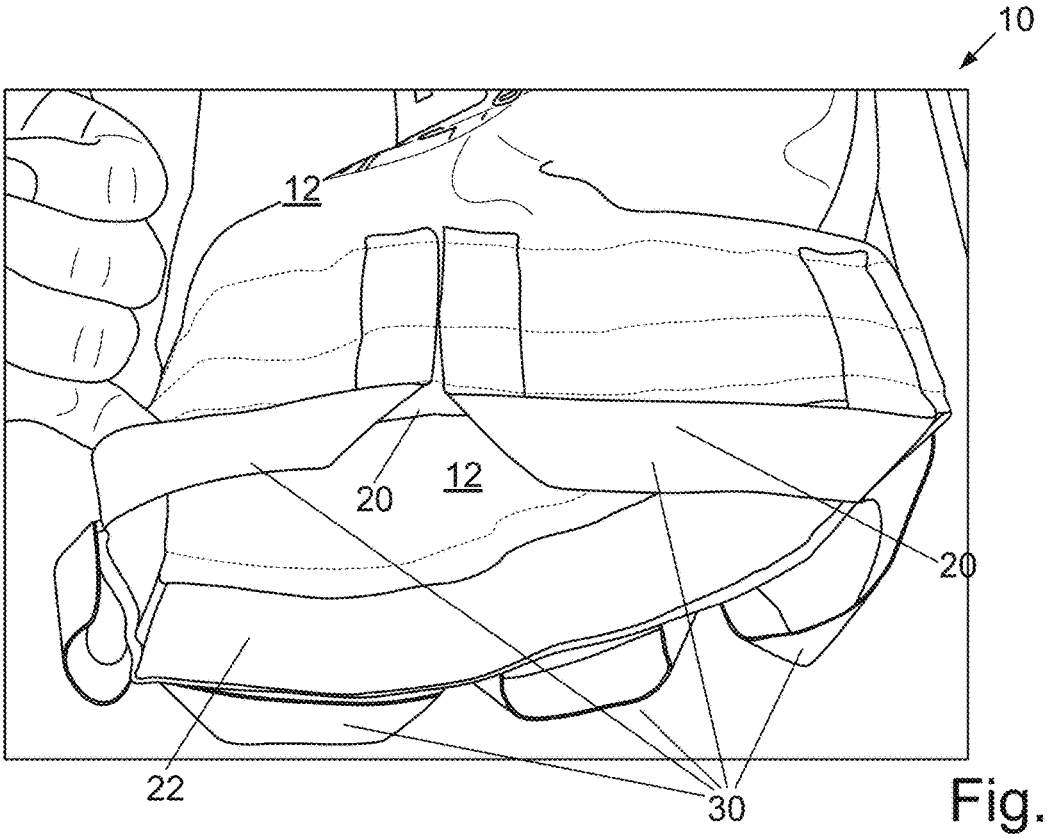
FIG. 2 is a perspective view of an open proximal end of a reconfigurable pillowcase in accordance with the principles of the invention.
Figure 3:
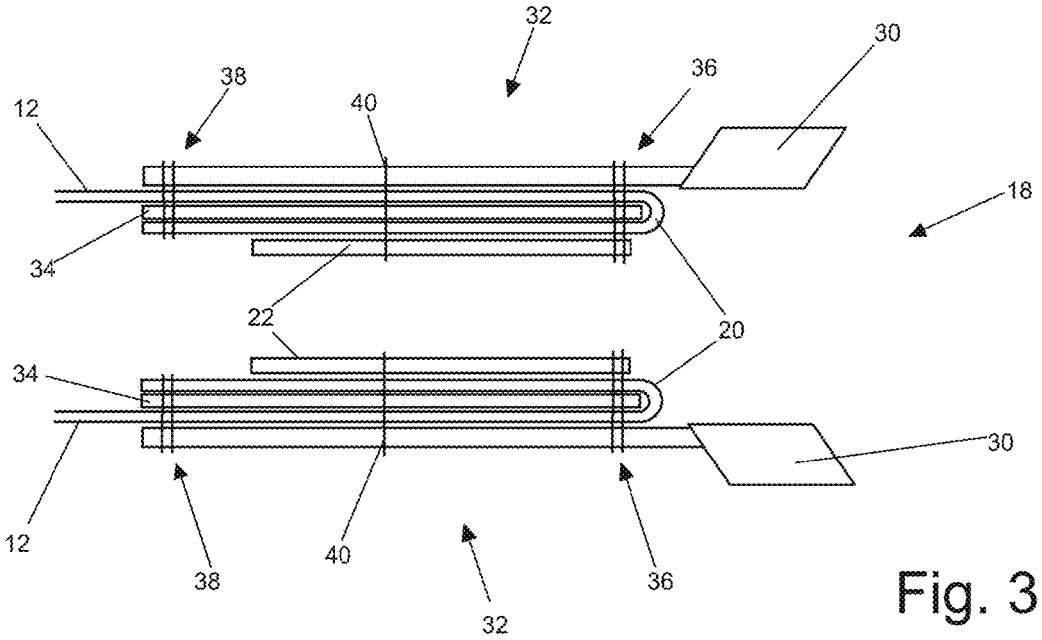
FIG. 3 is a cross-sectional side view of an open proximal end of a reconfigurable pillowcase in accordance with the principles of the invention.

FIGS. 2 and 3 show the proximal open end 18, which has an opening defined by the proximal edges 20 of the two opposing panels 12 and provides access to the interior of the pillowcase 10. Two opposing, complementary fastening strips 22 are located inside the pillowcase 10, on the internal sides of the panels 12 adjacent to and coextensive with the panels' proximal edges 20. In this embodiment, the opposing complementary fastening strips 22 are formed by complimentary hook-and-loop strips, e.g. Velcro®. Magnetic strips or other complementary fastener mechanisms may optionally be used. When the two fastening strips 22 are brought into contact, they seal the proximal open end 18 of the pillowcase 10. The pillowcase 10 is opened by pulling the complementary fastening strips 22 apart. When the proximal open end 18 is closed, the pillowcase 10 becomes substantially air- and water-tight. This allows air to be added to or removed from the interior of the pillowcase 10, thereby allowing an operator to adjust the amount of air in the pillowcase. This in turn will alter the sound generated by the pillow upon striking a surface or a participant in a pillow fight. The pillowcase panels 12 are also non-absorbent. As a result, the pillowcase 10 is more hygienic than a pillowcase made of cotton or other absorbent material. Pathogens such as viruses will not become incorporated into the fabric. It also generally produces a louder sound upon impact than that of a typical cotton pillowcase.

As best shown in FIG. 3, each of the proximal edges 20 of the respective panels 12 are formed by a turned hem 32 having an internal stabilizer 34. In this embodiment, the stabilizer 34 is an elongate, thin band of a plastic, such as for example polyethylene or polypropylene, which provides strength and rigidity to the turned hem 32, but is also flexible enough to be folded between adjacent handles 30. The panel 12, handles 30, fastening strip 22, and stabilizer 32 are all held together by stitching and/or adhesives. The turned hem 32 of this embodiment is sewn with a proximal double stitch 36, a distal double stitch 38 and a medial single stitch 40. The proximal double stitch 36 and the medial single stitch 40 extend through the handles 24 and 26, the panels 12, the stabilizer 32 and the fastening strip 22. The distal double stitch 38 extends through all of these components except for the fastening strip 22. The fastening strip 22 is also affixed to the panel 12 by an adhesive. Optionally, all of the components may be affixed together using only adhesive, only stitching, or any combinations of adhesive and stitching.

Figure 4:
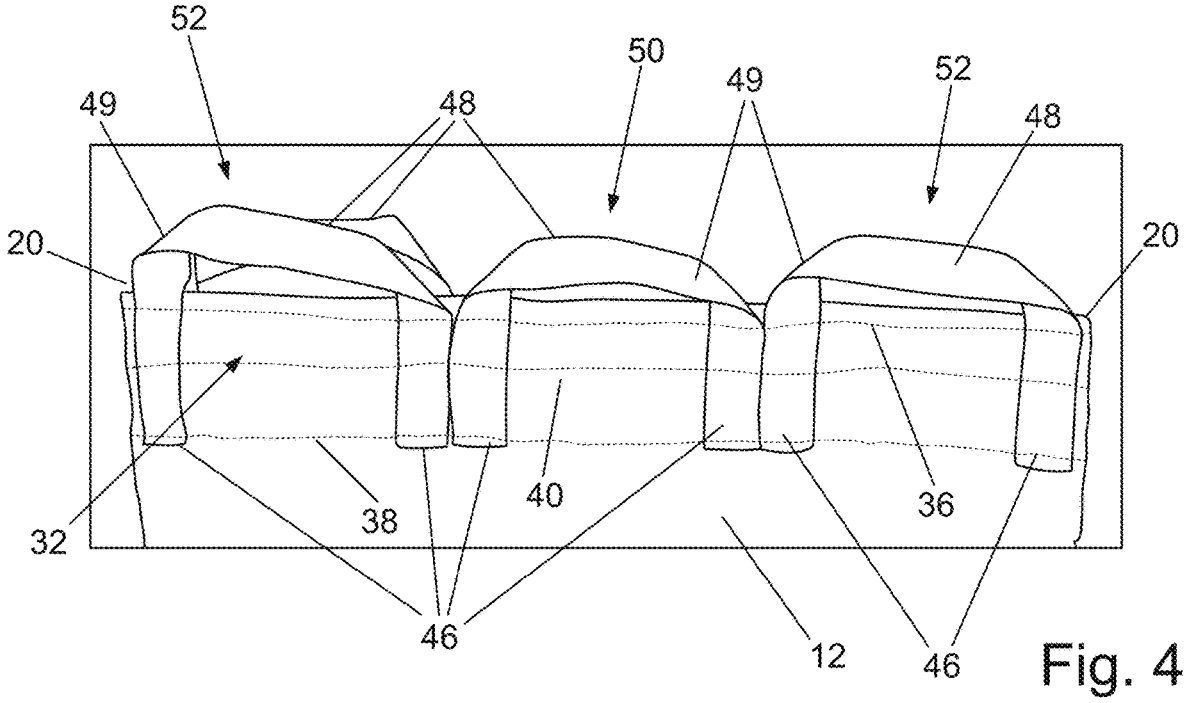
FIG. 4 is a top plan view of an open proximal end of a reconfigurable pillowcase in accordance with principles of the invention.

As best shown in FIG. 4, each of the panels 12 includes three equally sized U-shaped handles 30. The handles are formed from a ribbon, or web, of flexible material. In this embodiment, the handles 30 are formed from thick strips of vinyl. The anchoring ends 46 of each vinyl strip 44 lie flush against the panels 12 and extend distally from, and perpendicular to, the proximal edge 20 of each panel 12. This further strengthens and adds rigidity to the turned hems 32. The anchoring ends 46 of each handle 30 are parallel to and lie flush against either one of the lateral sides 14 of the panel, or an adjacent handle 30. The gripping region 48 of each handle 30 extends substantially parallel to the proximal edge 20 of the panel 12. All of the handles 30 are congruent, i.e. having the same dimensions, and extend in a proximal direction. Each handle 30 has a width approximately one third (⅓) the width of the proximal edge 20, such that the combined widths of the three handles 30 of each panel is equal to the width of the proximal edge 20 of the panel. The region of the handles 30 where anchoring ends 46 meet the gripping region 48 can form a 45° crease 49, which allows both the anchoring ends 46 and the gripping region 48 to lie parallel to the panel 12. This facilitates easy storage, packaging and transport of the reconfigurable pillowcase 10. When the proximal end 18 is close, the handles 30 on a panel 12 align with a corresponding opposing handle on the other panel. Thus, the pillowcase 10 has a pair of medial handles 50 and two pairs of lateral handles 52.

Figure 5:
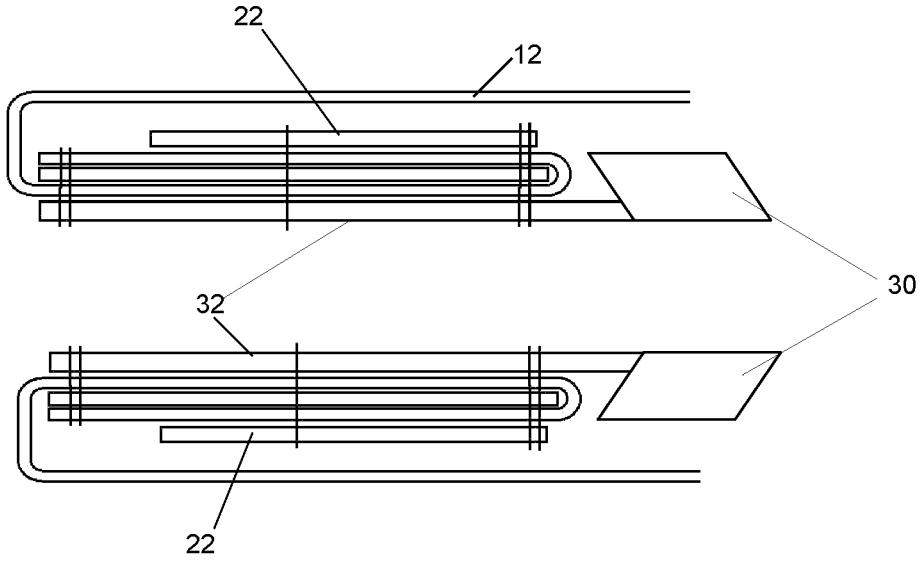
FIG. 5 is a cross-sectional view of an open proximal end of a reconfigurable pillowcase in the sleeping or recumbent configuration in accordance with principles of the invention.
Figure 6:
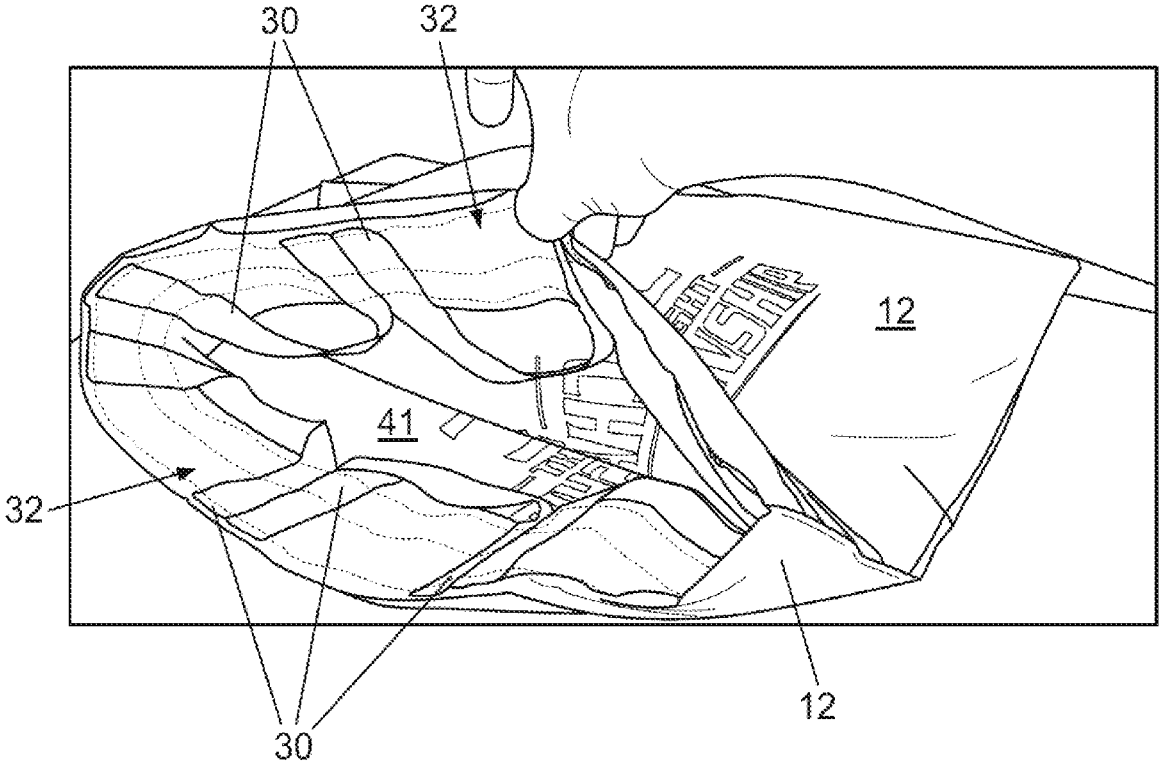
FIG. 6 is a perspective view of an open proximal end of a reconfigurable pillowcase in the sleeping or recumbent configuration in accordance with principles of the invention.

To convert the pillowcase 10 to a sleeping configuration, shown in FIGS. 5 and 6, the handles 30 and turned hems 32 are folded into the inside of the pillowcase 10. This is accomplished by detaching the fastening strips 22 and folding the turned hems 32 of the panels 12 into the interior of the pillowcase 10. In this configuration, the fastening strips cannot engage each other, and the pillowcase 10 will not seal closed. This improves comfort for a user of the pillowcase by allowing excess air to easily escape from the pillowcase. This configuration also retains the handles 30, which are not comfortable to rest one's head against, inside the pillowcase 10 and away from a user. The rigidity of the turned hem 32, created by the hem itself, the stabilizer 34, the fastening strips 22, the handles 30 prevent the pillowcase from unfolding out of the sleeping configuration.

Figure 7:
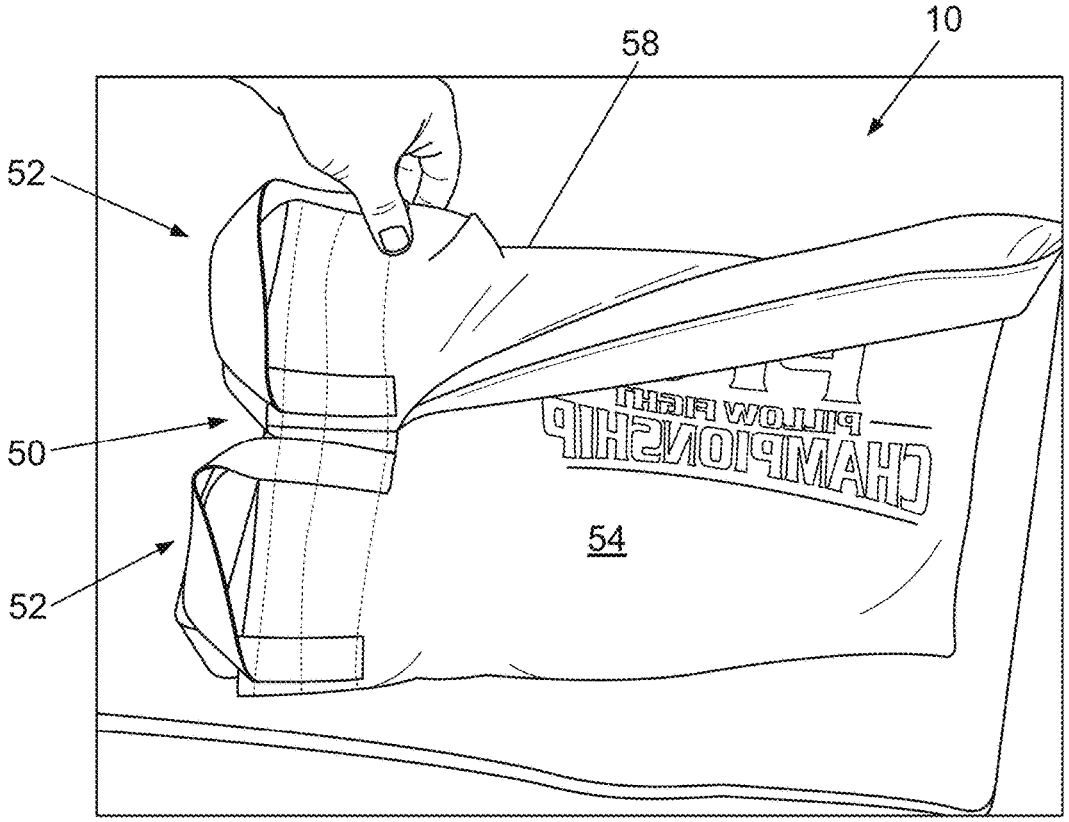
FIG. 7 is a perspective view of one pair of lateral handles folded over and aligned with the central pair of handles of a reconfigurable pillowcase in accordance with principles of the invention.
Figure 8:
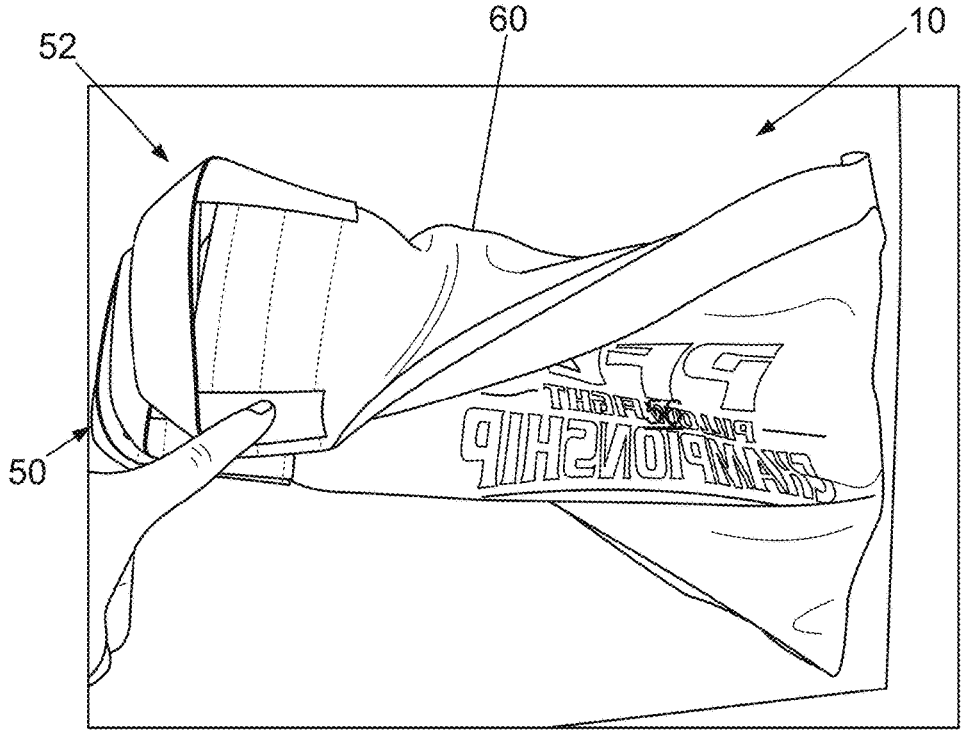
FIG. 8 is a perspective view of both pairs of lateral handles folded over opposite sides of the central pair of handles of a reconfigurable pillowcase in accordance with principles of the invention.
Figure 9:
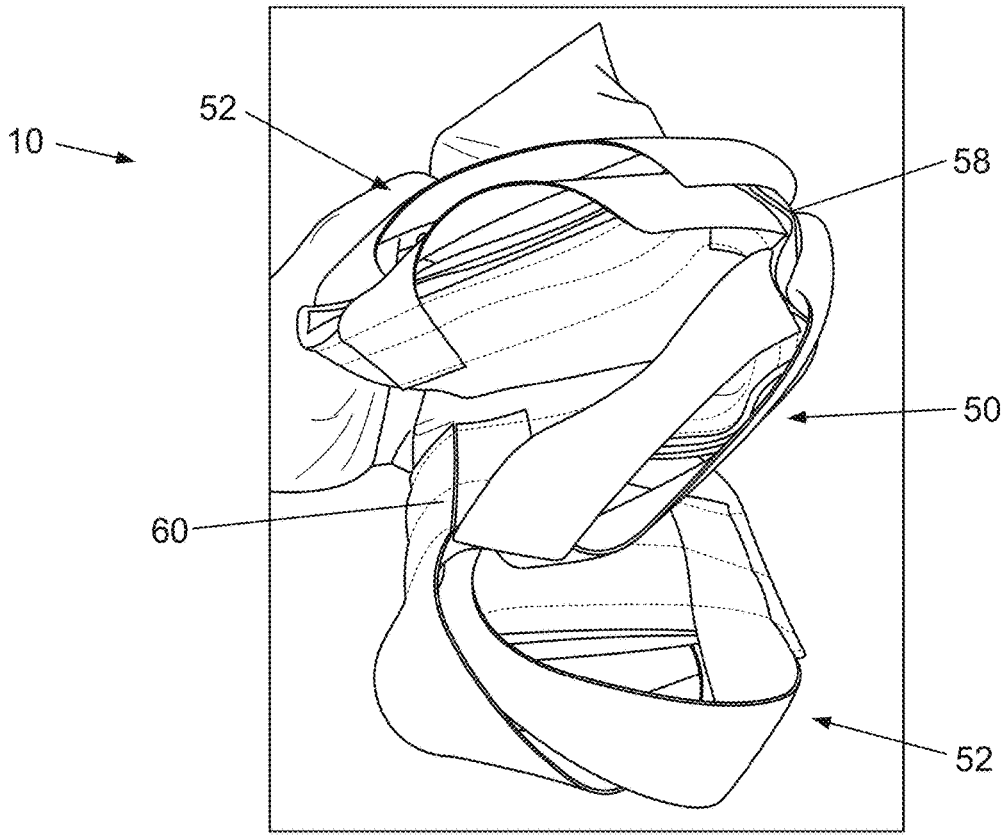
FIG. 9 is a perspective view of a reconfigurable pillowcase in a pillow fighting configuration in accordance with principles of the invention.
Figure 10:
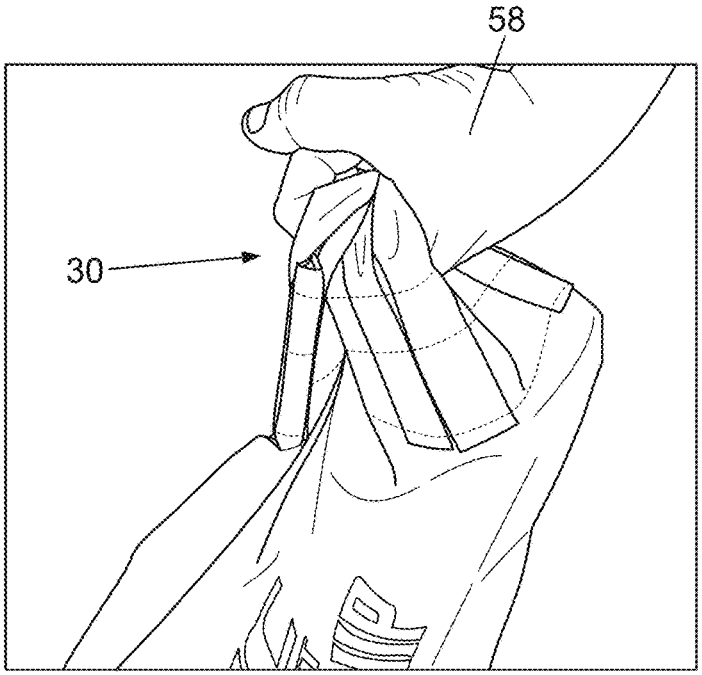
FIG. 10 is an environmental view of a reconfigurable pillowcase in a pillow fighting configuration wherein all of the handles are held by a single hand in accordance with principles of the invention.

FIGS. 7-10 show how the reconfigurable pillowcase 10 may be transformed into a fighting configuration. First, the fastening strips 22 are engaged to seal the proximal open end 18 and to align the handles 30 to form two to lateral handle pairs 52 and a medial handle pair 50. Referring to FIG. 7, one of the pairs of lateral handles 52 is folded over and aligned with the central handle pair 50 on a first side 54 of the pillowcase 10, thereby forming a first crease 58. Next, as shown in FIG. 8, the other lateral handle pair 52 is folded over a second side 56 of the pillowcase 10 and aligned with the opposite second side 56 of the central handle pair 50, thereby forming a second crease 60. Thus, all six handles 30 are aligned with each other, as shown in FIG. 9, using an accordion fold. This allows a user to engage all six handles 30 simultaneously with a single hand 58, as shown in FIG. 10.

Figure 11:
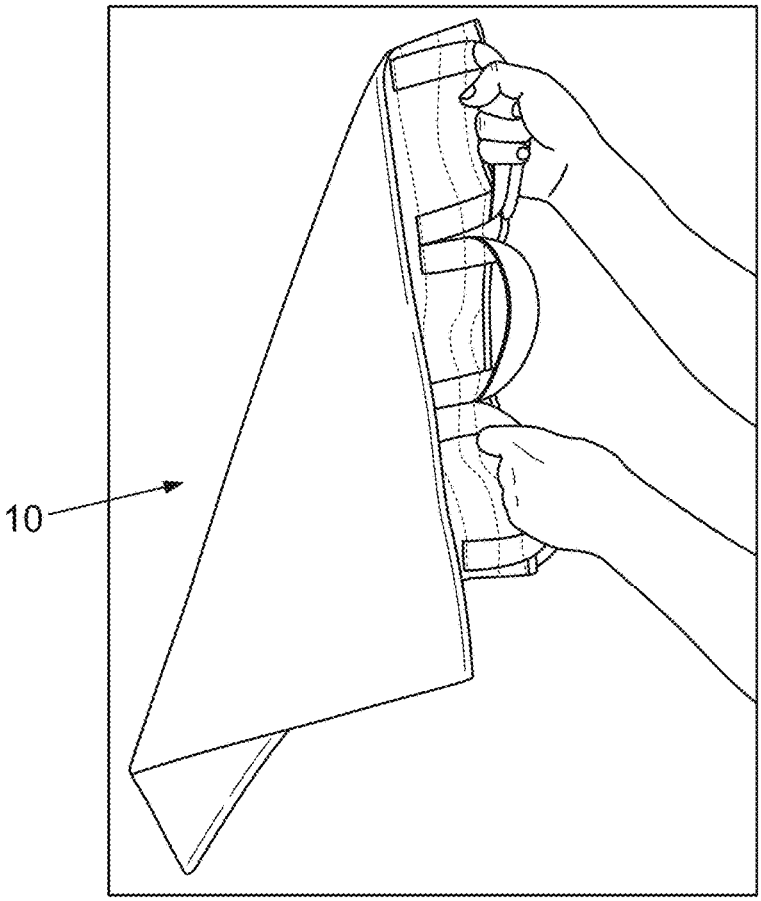
FIG. 11 is a perspective view of a reconfigurable pillowcase held at two corners not in the pillow fighting configuration.
Figure 12:
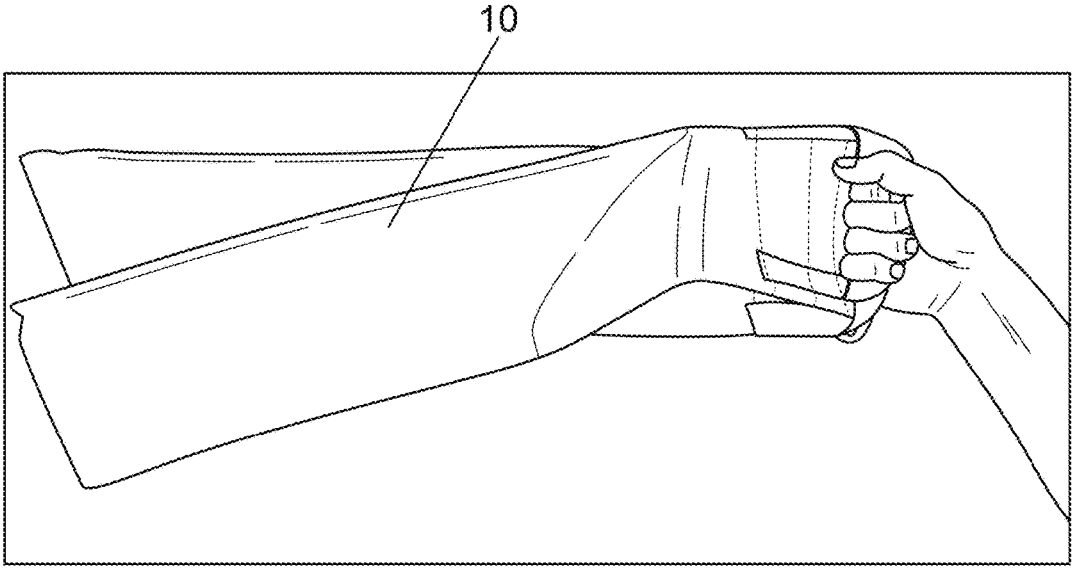
FIG. 12 is a perspective view of a reconfigurable pillowcase held in the pillow fighting configuration in accordance with principles of the invention.

The accordion folding formed by the fighting configuration improves control of motion of the pillowcase 10 during a pillow fight, because the accordion folding creates creases 58 and 60 between the medial handle pair 50 and each of the lateral handle pairs 52. These creases make the pillowcase 10 more rigid. This can be seen in FIGS. 11 and 12. FIG. 11 shows the pillowcase 10 held at two corners of the open end 18, as is common in pillow fighting of the prior art. The pillowcase has no rigidity, is flimsy, and hangs downward. FIG. 12 shows the pillowcase 10 in the accordion folded fighting configuration, where the two creases 58 and 60 provide sufficient linear rigidity between the open end 18 and the closed end 16, such that the pillowcase 10 extends horizontally rather than drooping downward under the force of gravity. The properly held pillowcase 10 will also maintain a conical shape during use. The rigidity of the pillowcase 10 can be further adjusted by increasing or decreasing the amount of air trapped within the pillowcase.

The pillowcase in accordance with the principles of the invention may be filled with a typical pillow, or any material generally considered suitable for use in a pillow, i.e. materials which are soft, low density and compressible. It is undesirable to sleep or pillow fight with a material that is heavy, solid or rigid, and dense, as such materials may cause injury.

Figure 13:
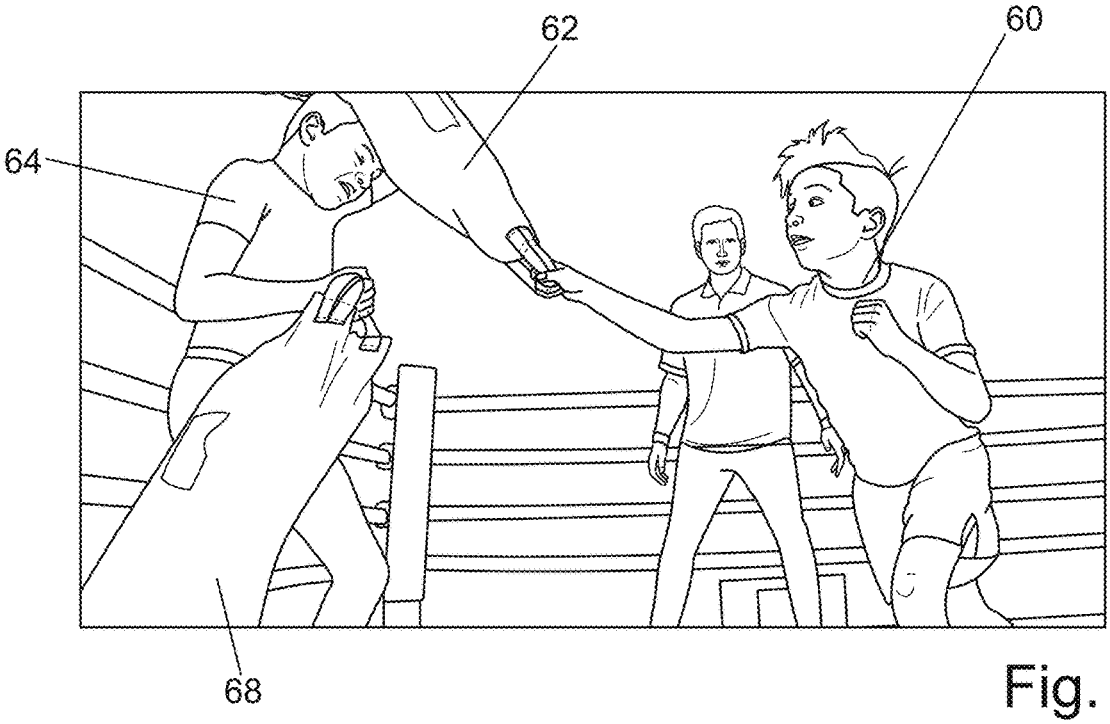
FIG. 13 is an environmental view of reconfigurable pillowcases used in a competitive pillow fighting match in accordance with principles of the invention.

FIG. 13 shows two participants in a pillow fight. Participant 60 is holding all six handles of a pillowcase 62 with one hand, which improves control of the pillowcase when swinging it toward participant 64. Participant 64 however, is only holding the pillowcase by four of the handles, not all six. As a result, his pillowcase 70 is bent, without a linear bias along the length of the pillowcase, even when hanging vertically downward. Participant 60 has a clear advantage.

Figure 14:
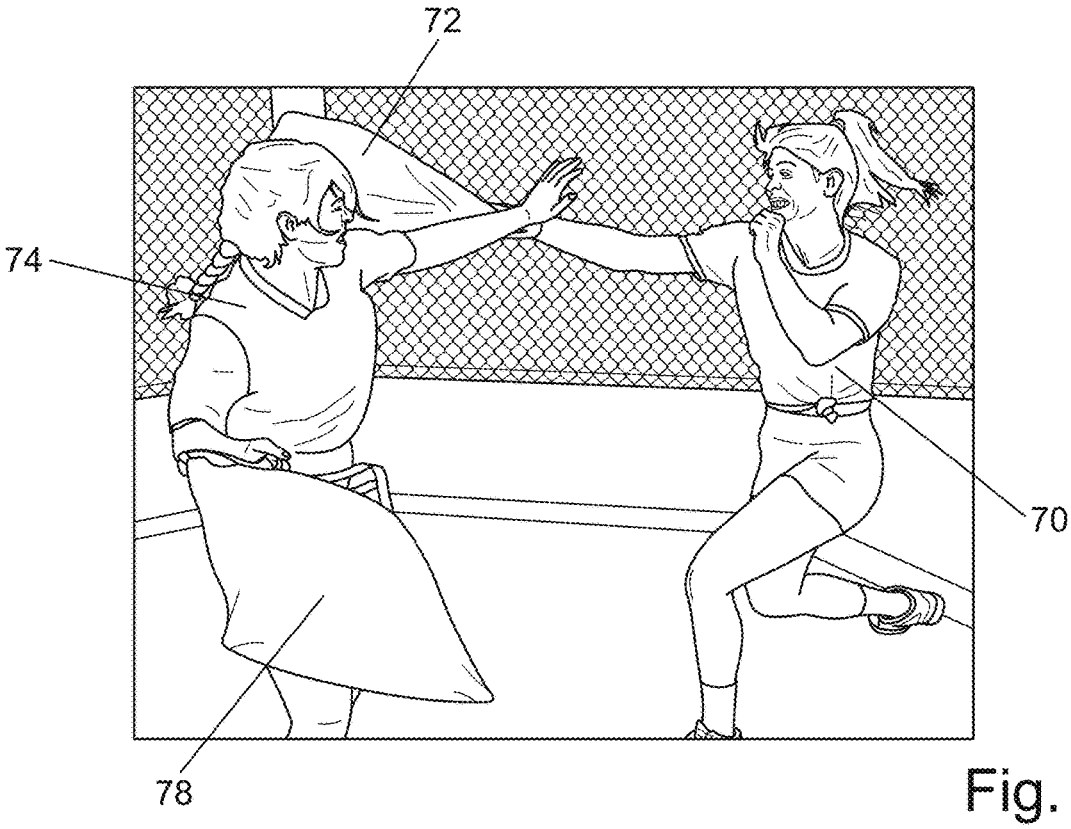
FIG. 14 is another environmental view of reconfigurable pillowcases used in the competitive pillow fighting match in accordance with principles of the invention.

Similarly, in FIG. 14, participant 70 is holding her pillowcase 72 using all six handles, and the creases are clearly visible, as is the conical shape of the pillow. This improves participant 70's ability to make an effective hit against participant 74. Participant 74 is only holding her pillowcase 76 by two of the handles, and as a result there are no creases and her pillow does not have the preferred conical shape. Participant 74's ability to control the pillow and make an effective hit on Participant 70 is greatly diminished.

FIGS. 15-17 show an alternative embodiment of a proximal end 80 of a reconfigurable pillowcase 82 in accordance with principles of the invention. The pillowcase 82 has the same structure and configuration as the pillowcase 10 except that it includes a soft lining 84 on the internal surface 86 of the two opposing congruent and coextensive panels 88. FIG. 15 shows a typical pillow 87 inside the pillowcase 82. Pillow 87 is a typical pillow which may be used in any embodiment of the invention. The inclusion of the soft lining 84 allows for a third possible configuration, a second sleeping or recumbent configuration, for the pillowcase 82. FIG. 13 shows the proximal end 82 which, like pillowcase 10, has three handles 90 extending in a proximal direction from the proximal end 80. Two complementary fastening strips 94 extend across the entire length of the proximal edge 96 of the opposing panels 88, and allow the proximal end 80 to be closed. Panels 88 are formed from a nonabsorbent, substantially airtight and watertight material, such as for example nylon ripstop, silk, vinyl or the like. The soft lining 84 extends across the entire inside surface 86 of both panels 88. The soft lining 84 may be formed from a soft material such as cotton, linen or other materials commonly used on a pillowcase. Those skilled in the art will appreciate that the material used to fill the pillowcase must be removed and reinserted during this process.

To transform the pillowcase 82 into an alternative sleeping configuration, the internal pillow is removed and the pillowcase 82 is inverted. I.e., it is turned inside out as shown in FIG. 14, so that the soft lining 84 now extends across the outside of the pillowcase 82, the inside surface 86 now serving as an outside surface. The pillow is then reinserted. To complete the reconfiguration to the second sleeping or recumbent configuration, the proximal end 80 of the pillowcase 82 is folded inward such that the handles 90 life flush against the opposing panels. This configuration is practically the same as the sleeping or recumbent configuration described above, except that the pillowcase 82 was reversed prior to folding the handles 90 into the pillowcase 82. One feature of this alternative reconfiguration is that the complementary fastening strips 94 face each other and may be affixed together to seal the pillowcase 82 while in a sleeping position. The soft lining 84 also provides a more comfortable surface when the pillowcase 82 is used to provide cushioning, such as for use as a typical pillow. The addition of an internal soft lining 84 and the inversion of the pillowcase prior to folding the handles inward will be recognized by those skilled in the art as readily incorporated into the above described embodiments of the invention.

Example of Competitive Pillow Fighting Rules

The reconfigurable pillowcases in accordance with the principles of the invention may be utilized in a spectator sport of competitive pillow fighting. The following are exemplary rules and guidelines for one embodiment of a competitive pillow fighting spectator sport:

Matches are evaluated by 3 judges and scored on a points-based system. Points will be awarded for landing hits and special moves, and points will be deducted for penalties. Hits must land above waist and must be swung at "full force" in order to count as points.

Knockdown—When a player causes an opponent to "fall down" or somehow touch the floor of the ring with a third point of support, which can be any part of the body. If an opponent falls, but it was not caused by a strike from the player, the opponent will simply get a 1 point deduction.

Rules:

- A floored/knocked down fighter has ten seconds to get up before losing the match by knockout.
- A fighter may not push or charge into their opponent with any part of the body or the pillow.
- You can only hold the pillow by the handles, one or both hands may be used, and you may hold one, two or all three handles at once.
- You cannot grab or hold on to your opponent or opponent's pillow.
- You cannot hold the pillow stationary over your head.
- No spitting, cursing, or foul language.
- At all times fighters must keep 3' between themselves during a round—no crowding.
- No open wounds or jewelry.

Points Awarded Per Round:

- Knockdown=3 points
- 360°=2 points
- Strike to Head=1 point
- Avoids Opponent's Hits, Display Showmanship=1 point per round (If both fighters equally avoid hits or display showmanship, then no points are awarded to either fighter for that round)

Definitions

Headshot—A clean blow landed above the shoulders.

Torso Shot—A clean blow landed on arms or torso that lies below the shoulders as well as above the groin.

360—a full spin followed by a clean strike on the opponent that results in a point.

Foul—An inappropriate or unfair act as deemed by the referee, which may be intentional or unintentional, and will result in a point deduction. This can be an illegal strike or any other illegal move that the referee deems worthy of a foul.

Blocking—illegal usage of any part of the body to block a strike other than the pillow. Blocking is not allowed. You may only avoid being hit by dodging opponents' pillows. Players may not raise arms above chest and no purposeful blocking with arms or hands. 3 or more offenses will result in a point deduction.

Charging—To rush forward, or to make illegal contact by pushing or moving any part of the player's body into the opponent's torso.

Grabbing—illegal use of the player's hand, arm, or leg to restrain or impede an opponent or an opponent's pillow.

Dropped Pillow—When a player, by his own fault, drops or loses control of his pillow, and will result in a 1 point deduction. Dropped pillows as a result of an illegal move by the opponent will not garner a point deduction.

Guidelines:

Swing pillow at full force
Be the aggressor
Dodge all possible hits
Incorporate showmanship into fight
Perform special moves as defined
Only strike with pillow Prohibit Actions:

Do not strike opponent with any part of your body
Don't drop your pillow
Do not grab opponent or their pillow
No pushing or charging opponent Whereas, the present invention has been described in relation to the drawings attached hereto, other and further modifications, apart from those shown or suggested herein, may be made within the spirit and scope of this invention. Those skilled in the art will appreciate that the conception, upon which this disclosure is based, may readily be utilized as a basis for the designing of other structures, methods and systems for carrying out the several purposes of the present invention. That is, the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. The descriptions of the embodiments shown in the drawings should not be construed as limiting or defining the ordinary and plain meanings of the terms of the claims unless such is explicitly indicated. The claims should be regarded as including such equivalent constructions insofar as they do not depart from the spirit and scope of the present invention.

The invention claimed is:

1. A reconfigurable pillowcase comprising:

a pillowcase formed by two congruent panels connected to each other on three sides, having an opening on a fourth side defined by opposing edges of the two congruent panels which are not connected;

two opposing, complementary fastening strips on internal sides the two congruent panels adjacent to the opposing edges, the fastening strips being coextensive with the edge of the panel to which it is adjacent;

three colinear, equally sized handles affixed to the exterior side of each panel adjacent to the proximal edges, wherein each of the handles has a width equal to one third of a width of the opposing proximal edges;

a pillow positioned inside the pillowcase;

wherein the pillowcase translates from a sleeping configuration to a fighting configuration by engaging the two opposing fastening strips to close the proximal open end, thereby aligning the extending handles of the opposing panels into three pairs of handles, and then folding the three pairs of handles over each other to form a single handle capable of being grasped by one hand, thereby creating distally tapering creases in the pillowcase.

2. The reconfigurable pillowcase of claim 1 wherein each of the panels further comprises a reinforcement strip adjacent to and coextensive with the edge of the panel to which it is attached.

3. The reconfigurable pillowcase of claim 2 wherein each of the handles comprises a ribbon of flexible material having a handle region which extends parallel to the edges of the panels and folded by a 45° crease at each end to form attachment points extending perpendicularly to the handle region, the attachment points being stitched to the panel to which it is attached.

4. The reconfigurable pillowcase of claim 3 wherein each of the panels further comprises two backing strips coextensive with the each of the fastening strips, each positioned between one of the fastening strips and the exterior sides of the panels.

5. The reconfigurable pillowcase of claim 4 wherein the panels are formed from a material substantially impermeable to water and air.

6. The reconfigurable pillowcase of claim 5 wherein the two opposing panels are formed from a single piece of material folded in half.

7. The reconfigurable pillowcase of claim 6 further comprising a soft lining on the internal sides of the opposing panels; and, wherein the pillowcase translates to an alternative sleeping configuration by removing the pillow, inverting the pillowcase by turning the pillowcase inside out so that the soft lining of the internal sides of the panels extends across the outside of the pillowcase, reinserting the pillow into the inverted pillowcase, folding the proximal end of the pillowcase inward so that the handles lie flush against the opposing panels and the fastening strips face each other, and engaging the opposing fastening strips to close the proximal open end of the pillowcase.

* * * * *